US011072399B2

(12) United States Patent
Terada

(10) Patent No.: US 11,072,399 B2
(45) Date of Patent: Jul. 27, 2021

(54) HYDROFOIL CRAFT

(71) Applicant: YAMAHA HATSUDOKI KABUSHIKI KAISHA, Iwata (JP)

(72) Inventor: Kohei Terada, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 0 days.

(21) Appl. No.: 16/590,451

(22) Filed: Oct. 2, 2019

(65) Prior Publication Data

US 2020/0172206 A1 Jun. 4, 2020

(30) Foreign Application Priority Data

Nov. 29, 2018 (JP) ..... JP2018-223719

(51) Int. Cl.
*B63B 34/10* (2020.01)
*B63H 11/02* (2006.01)

(52) U.S. Cl.
CPC ..... *B63B 34/10* (2020.02); *B63H 11/02* (2013.01)

(58) Field of Classification Search
CPC ..... B63B 34/10; B63B 34/40; B63B 32/10; B63B 32/20; B63B 32/60; B63H 11/02
USPC ..... 114/274, 151; 440/40
See application file for complete search history.

(56) References Cited

U.S. PATENT DOCUMENTS 2,931,332 A * 4/1960 Hebrank ..... B63B 32/10 114/55.54
3,294,055 A * 12/1966 McGuire ..... B63B 34/10 114/55.55
3,964,417 A * 6/1976 Williams ..... B63B 1/20 114/274
5,582,125 A * 12/1996 Matsumoto ..... B63H 25/46 114/55.5
6,070,543 A * 6/2000 A'Lateef ..... B63B 1/322 114/55.55
6,178,905 B1 * 1/2001 Dynes ..... B63B 1/285 114/55.54
7,144,285 B1 12/2006 Hendricks
8,820,260 B2 9/2014 Brizzolara

FOREIGN PATENT DOCUMENTS

CH 591358 A5 * 9/1977 ..... B63B 1/24

* cited by examiner

*Primary Examiner* — Anthony D Wiest
(74) *Attorney, Agent, or Firm* — Keating and Bennett, LLP

(57) ABSTRACT

A hydrofoil craft includes a deck, a hydrofoil disposed below the deck, a thruster that generates a thrust, and a thrust operator. The deck includes a chest placing portion on which a chest of a vessel operator is placed and a lower-limb placing portion that is disposed at a more rearward position than the chest placing portion and on which a lower limb of the vessel operator is placed, and the deck is arranged such that the vessel operator is able to ride on the deck in a prone position. The thrust operator is operated by the vessel operator to adjust the thrust of the thruster.

26 Claims, 8 Drawing Sheets

HYDROFOIL CRAFT

CROSS REFERENCE TO RELATED APPLICATIONS

This application claims the benefit of priority to Japanese Patent Application No. 2018-223719 filed on Nov. 29, 2018. The entire contents of this application are hereby incorporated herein by reference.

BACKGROUND OF THE INVENTION

1. Field of the Invention

The present invention relates to a hydrofoil craft.

2. Description of the Related Art

A surf board disclosed in the description of U.S. Pat. No. 7,144,285 includes a hull on which a rider can ride in a prone position, a front hydrofoil and a rear hydrofoil that are disposed below the hull, and a grip that is grasped by the rider riding on the hull in order to maintain his/her posture.

The surf board described in the description of U.S. Pat. No. 7,144,285 proceeds on waves, and therefore the speed of the surf board depends on wave velocity. Therefore, the rider on the surf board cannot easily control the speed of the surf board. If there is no wave, a thrust cannot be obtained unless the rider paddles by himself/herself. If a vessel having a thruster is used, a vessel operator can control the speed of the vessel by adjusting the thrust of the thruster. However, a person who desires to pilot a vessel provided with a thruster that generates a thrust equal to or greater than a predetermined value is required to obtain a prescribed license and/or to satisfy a prescribed age limit, depending on a region or a district. On the other hand, if a low thrust vessel without such a license and/or an age limit is used, the maximum speed of this vessel is low, and therefore it is difficult to provide a feeling of speed to the vessel operator.

SUMMARY OF THE INVENTION

In order to overcome the previously unrecognized and unsolved challenges described above, preferred embodiments of the present invention provide hydrofoil crafts that each includes a deck, a hydrofoil disposed below the deck, a thruster that generates a thrust, and a thrust operator. The deck includes a chest placing portion on which a chest of a vessel operator is placed and a lower-limb placing portion that is disposed at a more rearward position than the chest placing portion and on which a lower limb of the vessel operator is placed, and the deck is arranged such that the vessel operator is able to ride on the deck in a prone position. The thrust operator is operated by the vessel operator to adjust the thrust of the thruster.

According to this structural arrangement, the vessel operator places the chest on the chest placing portion, and places the lower limb on the lower-limb placing portion, and thus rides on the deck of the hydrofoil craft in a prone position. Therefore, the eye line (line of sight) of the vessel operator is near the water surface, and therefore the vessel operator easily feels a speed difference between himself/herself and the water surface. This makes it possible to provide a feeling of speed to the vessel operator. Additionally, it is possible for the vessel operator to control the speed by adjusting the thrust of the thruster while operating the thrust operator.

In a preferred embodiment of the present invention, the chest placing portion has a shape extending along at least a portion of the chest of the vessel operator, and the lower-limb placing portion has a shape extending along at least a portion of the lower limb of the vessel operator. According to this structural arrangement, the position of the chest placed on the chest placing portion and the position of the lower limb placed on the lower-limb placing portion are stabilized, thus enabling the vessel operator to ride on the hydrofoil craft in a stable posture and to feel and/or control its speed.

In a preferred embodiment of the present invention, an upper surface of at least one of the chest placing portion and the lower-limb placing portion has a concave shape. According to this structural arrangement, the chest is placed on the concave-shaped upper surface in the chest placing portion, and/or the lower limb is placed on the concave-shaped upper surface in the lower-limb placing portion, and therefore the posture of the vessel operator is stabilized. This enables the vessel operator to ride on the hydrofoil craft in a stable posture and to feel and/or control its speed.

In a preferred embodiment of the present invention, the upper surface of the chest placing portion is tilted more downwardly as it extends toward a rearward end of the upper surface. This structural arrangement enables the vessel operator whose chest is placed on the upper surface of the chest placing portion to ride on the hydrofoil craft in a stable posture without falling forwardly and to feel and/or control its speed.

In a preferred embodiment of the present invention, the deck further includes an upper-limb placing portion that is disposed at a more forward position than the chest placing portion and on which an upper limb of the vessel operator is placed. According to this structural arrangement, the vessel operator places the upper limb on the upper-limb placing portion, thus enabling the vessel operator to ride on the hydrofoil craft in a posture in which the arms are stretched forwardly and to feel and/or control its speed.

In a preferred embodiment of the present invention, the upper-limb placing portion has a shape extending along at least a portion of the upper limb of the vessel operator. According to this structural arrangement, the position of the upper limb placed on the upper-limb placing portion is stabilized, thus enabling the vessel operator to ride on the hydrofoil craft in a stable posture and to feel and/or control its speed.

In a preferred embodiment of the present invention, the deck further includes a head placing portion that is disposed at a more forward position than the chest placing portion and on which a head of the vessel operator is placed. An upper surface of the head placing portion has a concave shape. According to this structural arrangement, the posture of the vessel operator is stabilized by placing the head of the vessel operator on the concave-shaped upper surface in the head placing portion. This enables the vessel operator to ride on the hydrofoil craft in a stable posture and to feel and/or control its speed.

In a preferred embodiment of the present invention, the upper-limb placing portion includes a left-arm placing portion on which a left arm of the vessel operator is placed and a right-arm placing portion that is disposed at a more rightward position than the left-arm placing portion and on which a right arm of the vessel operator is placed. According to this structural arrangement, the vessel operator places the left arm on the left-arm placing portion and places the right arm on the right-arm placing portion, thus enabling the vessel operator to ride on the hydrofoil craft in a posture in which the left and right arms are stretched forwardly and to feel and/or control its speed.

In a preferred embodiment of the present invention, a distance (left-right interval) between the left-arm placing portion and the right-arm placing portion becomes greater as they extend forward from the chest placing portion. This structural arrangement enables the vessel operator to ride on the hydrofoil craft in a posture in which his/her left and right arms are stretched forwardly and are widened leftwardly and rightwardly and to feel and/or control its speed.

In a preferred embodiment of the present invention, the left-arm placing portion and the right-arm placing portion are arranged laterally symmetrically. According to this structural arrangement, the vessel operator laterally symmetrically extends the left and right arms, thus enabling the vessel operator to ride on the hydrofoil craft in a stable posture and to feel and/or control its speed.

In a preferred embodiment of the present invention, the lower-limb placing portion includes a left-leg placing portion on which a left leg of the vessel operator is placed and a right-leg placing portion that is disposed at a more rightward position than the left-leg placing portion and on which a right leg of the vessel operator is placed. According to this structural arrangement, the vessel operator places the left leg on the left-leg placing portion and places the right leg on the right-leg placing portion, thus enabling the vessel operator to ride on the hydrofoil craft in a stable posture and to feel and/or control its speed.

In a preferred embodiment of the present invention, a distance between the left-leg placing portion and the right-leg placing portion becomes greater as they extend rearward from the chest placing portion. This structural arrangement enables the vessel operator to ride on the hydrofoil craft in a posture in which his/her left and right legs are widened leftwardly and rightwardly and to feel and/or control its speed.

In a preferred embodiment of the present invention, the left-leg placing portion and the right-leg placing portion are arranged laterally symmetrically. This structural arrangement enables the vessel operator to ride on the hydrofoil craft in a stable posture by extending his/her left and right legs laterally symmetrically and to feel and/or control its speed.

In a preferred embodiment of the present invention, the thrust operator includes a left thrust operator disposed at the left-arm placing portion and a right thrust operator disposed at the right-arm placing portion. According to this structural arrangement, the vessel operator adjusts the thrust of the thruster by at least one of the operation of the left thrust operator with the left hand and the operation of the right thrust operator with the right hand, thus enabling the vessel operator to control the speed of the hydrofoil craft.

In a preferred embodiment of the present invention, in a vertical direction, the left thrust operator is disposed at a more downward position than a center of the left-arm placing portion, and the right thrust operator is disposed at a more downward position than a center of the right-arm placing portion. This structural arrangement makes it possible to dispose both the left thrust operator and the right thrust operator below the sight line of the vessel operator. In this case, it becomes difficult for both the left thrust operator and the right thrust operator to enter the field of vision of the vessel operator, and therefore the vessel operator more easily feels a speed difference between himself/herself and the water surface. This makes it possible to more greatly provide a feeling of speed to the vessel operator.

In a preferred embodiment of the present invention, the left thrust operator and the right thrust operator are disposed laterally symmetrically. According to this structural arrangement, the left hand and the right hand of the vessel operator respectively operating the left thrust operator and the right thrust operator are disposed laterally symmetrically, thus enabling the vessel operator to ride on the hydrofoil craft in a stable posture and to feel and/or control its speed.

In a preferred embodiment of the present invention, the thruster includes a left and right pair of thrusters. A thrust of a first thruster of the left and right pair of thrusters is adjusted by an operation of the left thrust operator by the vessel operator, and a thrust of a second thruster of the left and right pair of thrusters is adjusted by an operation of the right thrust operator by the vessel operator. According to this structural arrangement, the vessel operator operates the left thrust operator and the right thrust operator, and adjusts the thrust of the first thruster and the thrust of the second thruster, thus enabling the vessel operator to control the craft's speed. Additionally, the vessel operator operates at least one of the left thrust operator and the right thrust operator so as to make a difference between the thrust of the first thruster and the thrust of the second thruster, thus making it possible to turn the hydrofoil craft rightwardly or leftwardly.

In a preferred embodiment of the present invention, the hydrofoil includes a front hydrofoil that is tilted more downwardly from an outer edge of the deck as the front hydrofoil extends toward a rearward end of the front hydrofoil. According to this structural arrangement, it is possible to achieve an arrangement that enables the vessel operator to receive a feeling of speed and that enables the vessel operator to control the speed while enabling the hydrofoil craft to become more compact in the front-rear direction than in a case in which the front hydrofoil extends forwardly.

In a preferred embodiment of the present invention, the front hydrofoil is tilted more downwardly as the front hydrofoil extends toward the rearward end of the front hydrofoil from left and right end portions of the upper-limb placing portion. According to this structural arrangement, it is possible to achieve an arrangement that enables the vessel operator to receive a feeling of speed and that enables the vessel operator to control the speed while enabling the hydrofoil craft to become more compact in the front-rear direction than in a case in which the front hydrofoil extends forwardly from the end portions of the upper-limb placing portion.

In a preferred embodiment of the present invention, the left-arm placing portion and the right-arm placing portion are tilted more downwardly as they extend forward from the chest placing portion. The front hydrofoil connects a left lower edge of the left-arm placing portion and a right lower edge of the right-arm placing portion together. This structural arrangement makes it possible to dispose the left arm placed on the left-arm placing portion and the right arm placed on the right-arm placing portion below the sight line of the vessel operator. In this case, it becomes difficult for both the left arm and the right arm of the vessel operator to enter the field of vision of the vessel operator, and therefore the vessel operator more easily feels a speed difference between himself/herself and the water surface. This makes it possible to more greatly provide a feeling of speed to the vessel operator. Additionally, the hydrofoil connects the left lower edge of the left-arm placing portion and the right lower edge of the right-arm placing portion together, thus making it possible to reinforce these arm placing portions.

In a preferred embodiment of the present invention, the front hydrofoil includes a left portion that first extends rightward and downward from the left lower edge of the left-arm placing portion and then extends rightward and upward, and a right portion that first extends leftward and downward from the right lower edge of the right-arm placing portion and then extends leftward and upward. According to this structural arrangement, the left portion and the right portion each preferably has the shape of the letter V, and the front hydrofoil including these laterally-disposed portions contributes to stabilizing the posture of the hydrofoil craft. This makes it possible to achieve an arrangement that enables the vessel operator to receive a feeling of speed and that enables the vessel operator to control the speed while enabling the hydrofoil craft to stably travel.

In a preferred embodiment of the present invention, the hydrofoil craft further includes a reinforcing portion that extends downwardly from the deck and that is connected to the front hydrofoil. According to this structural arrangement, it is possible to achieve an arrangement that enables the vessel operator to receive a feeling of speed and that enables the vessel operator to control the speed while reinforcing the deck and the front hydrofoil by the reinforcing portion.

In a preferred embodiment of the present invention, the hydrofoil includes a rear hydrofoil disposed at a more rearward position than the front hydrofoil. According to this structural arrangement, it is possible to achieve an arrangement that enables the vessel operator to receive a feeling of speed, and that enables the vessel operator to control the speed while enabling the hydrofoil craft to stably travel with the front hydrofoil and the rear hydrofoil that are spaced apart in the front-rear direction.

In a preferred embodiment of the present invention, the thruster is disposed at the hydrofoil. According to this structural arrangement, it is possible to dispose the thruster at a submerged position without separately using a holding member such as a bracket.

In a preferred embodiment of the present invention, the thruster is attached to the rear hydrofoil. According to this structural arrangement, water that is forced out rearwardly by a thrust generated by the thruster does not easily disturb a water flow around the front hydrofoil and the rear hydrofoil, and therefore the function of the front hydrofoil and the function of the rear hydrofoil are not encumbered.

In a preferred embodiment of the present invention, the hydrofoil is attachable to and detachable from the deck. This structural arrangement enables vessel operators having various physical sizes to operate the hydrofoil craft, for example, by preparing a plurality of hydrofoils that are mutually different in size and by replacing a hydrofoil with another in accordance with the physical size of a vessel operator. Additionally, it is possible to compactly store the hydrofoil craft by detaching the hydrofoil from the deck and then disassembling the hydrofoil craft.

In a preferred embodiment of the present invention, the thruster includes an electric motor. The hydrofoil craft further includes a power generator that is disposed at the deck and that generates electric power to operate the electric motor. This structural arrangement enables the thruster to generate a thrust by a driving force generated by the electric motor that receives electric power generated by the power generator.

In a preferred embodiment of the present invention, the power generator is disposed in a central area in the right-left direction of the deck. This structural arrangement makes it possible to dispose the power generator adjacent or near the gravity center of the hydrofoil craft, and thus makes it possible to achieve an arrangement that enables the vessel operator to receive a feeling of speed and that enables the vessel operator to control the speed while improving the kinematic performance of the hydrofoil craft.

In a preferred embodiment of the present invention, the hydrofoil craft further includes a float provided in at least one of the deck and the hydrofoil. According to this structural arrangement, the hydrofoil craft floats at a standstill due to the float, thus enabling the vessel operator to easily ride on or dismount from the hydrofoil craft when it is at a standstill. This makes it possible to achieve an arrangement that enables the vessel operator to receive a feeling of speed and that enables the vessel operator to control the speed while enabling the vessel operator to easily ride on or dismount from the craft.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
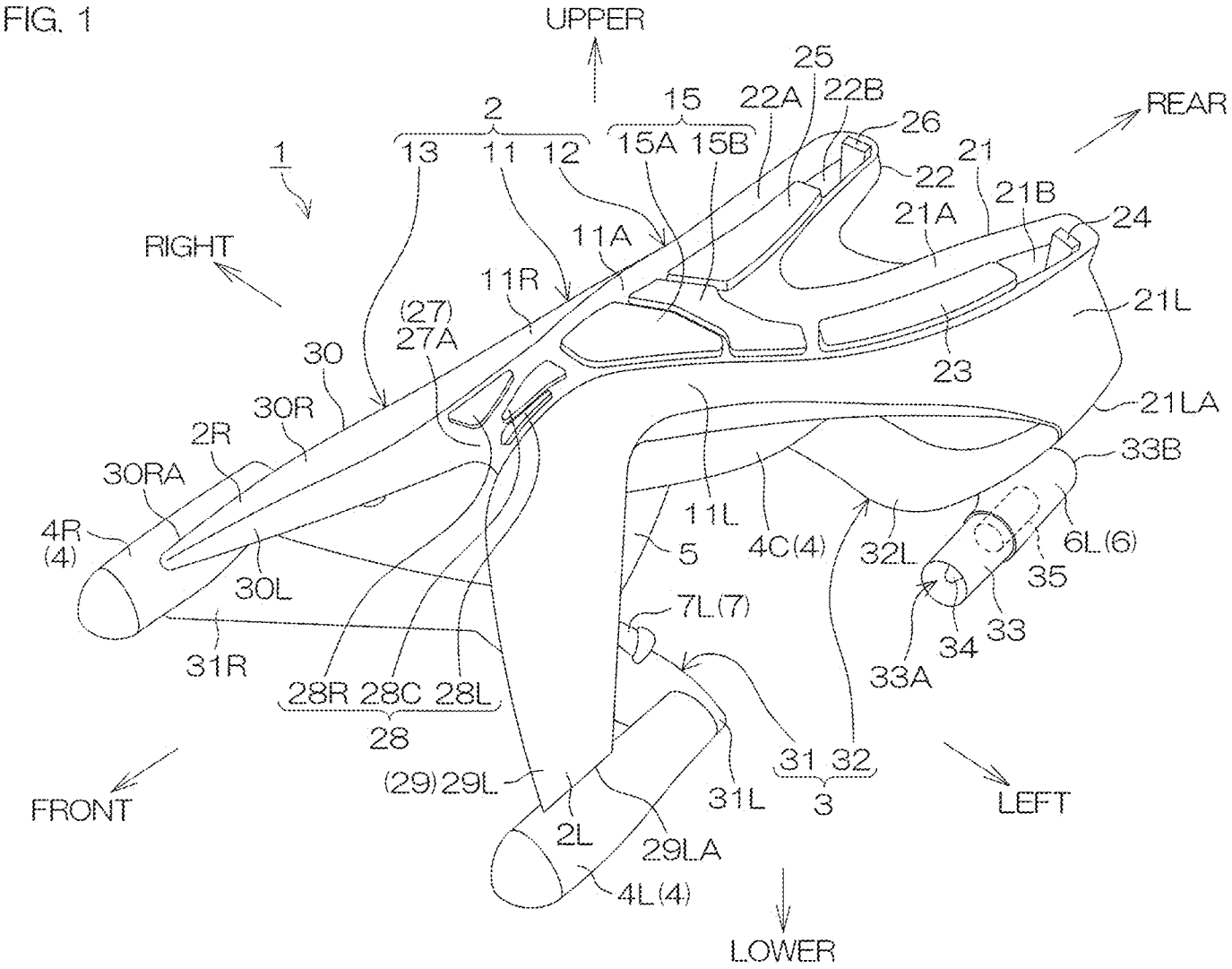
FIG. 1 is a perspective view of a hydrofoil craft according to a preferred embodiment of the present invention.
Figure 2:
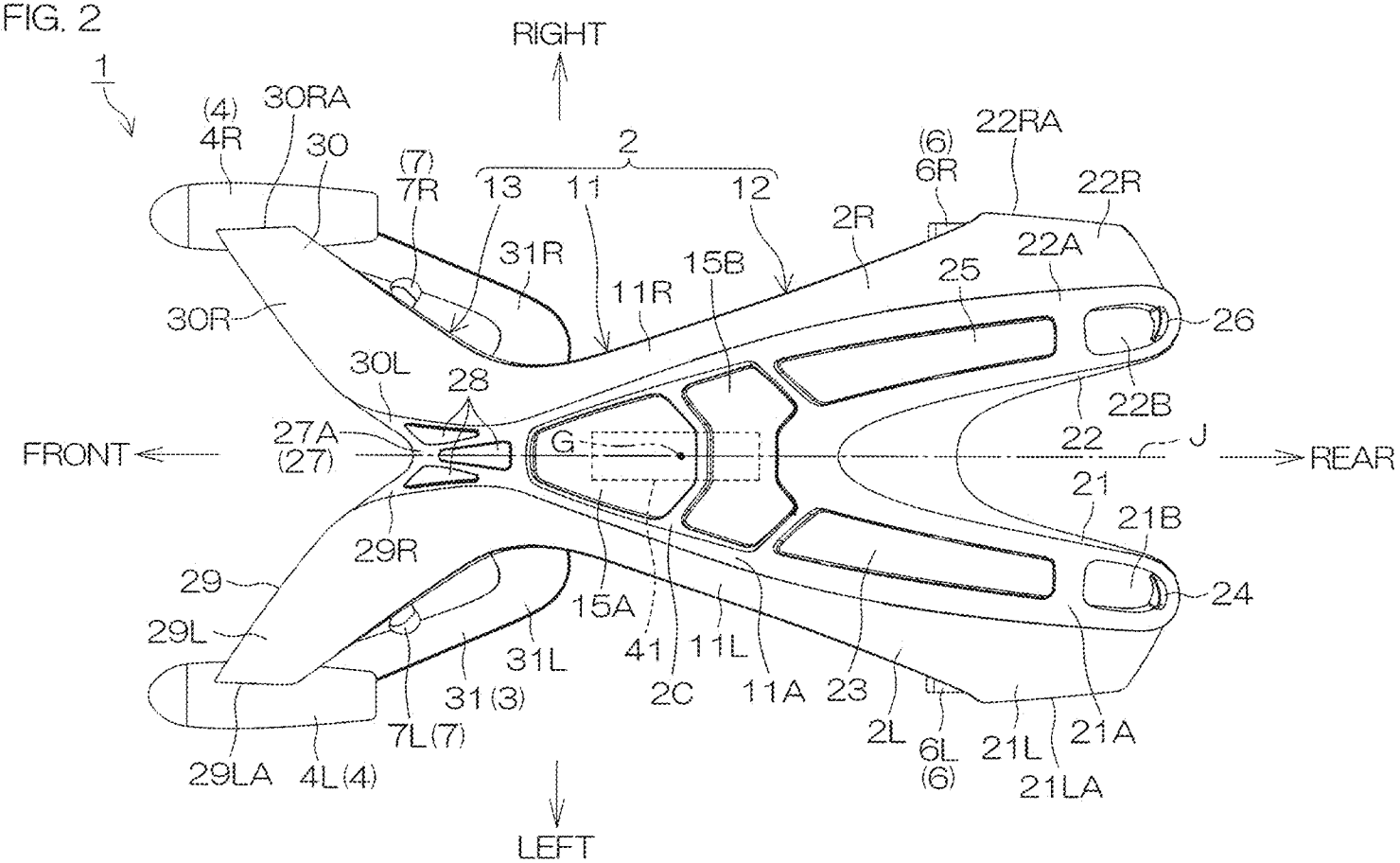
FIG. 2 is a plan view of the hydrofoil craft.
Figure 3:
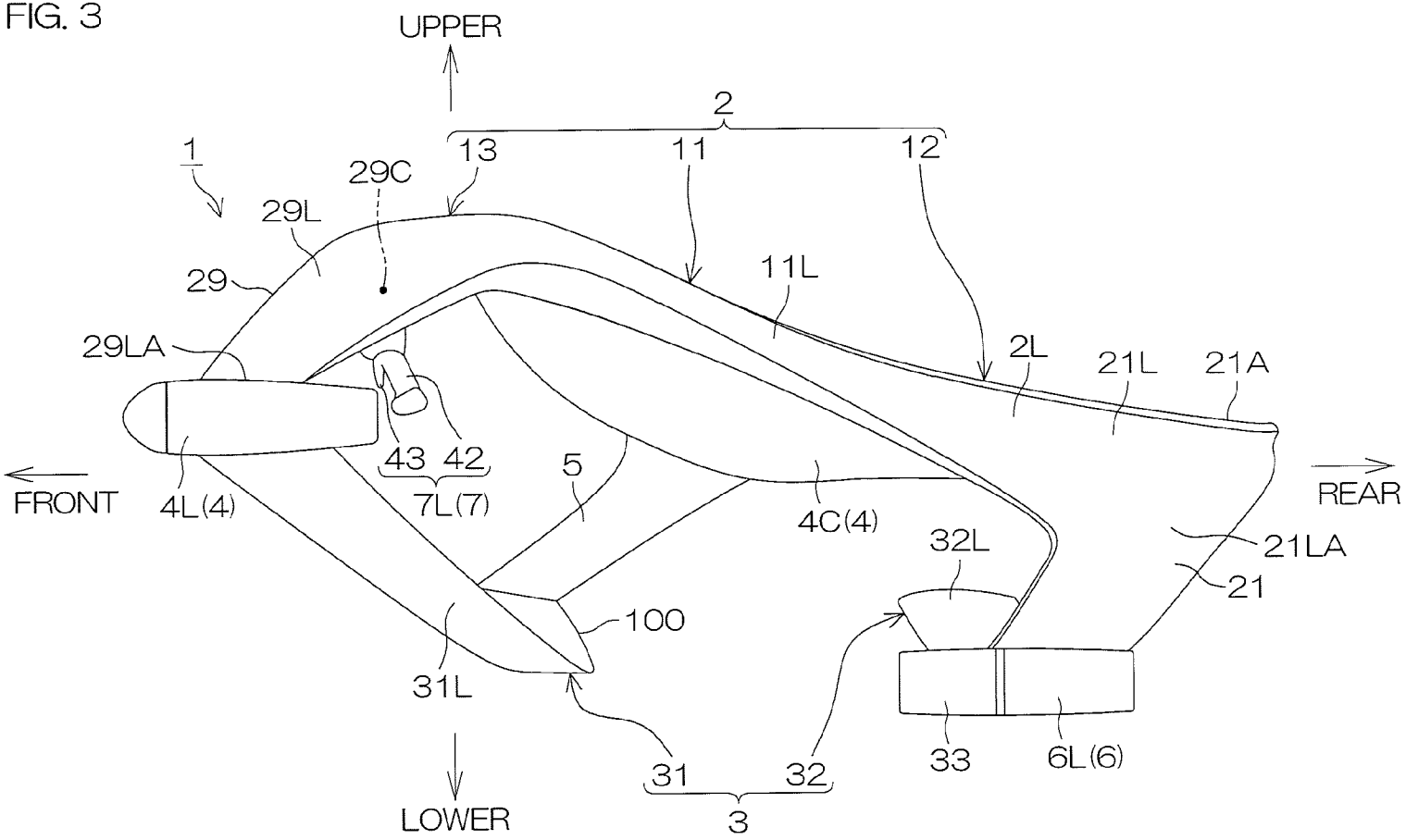
FIG. 3 is a left side view of the hydrofoil craft.
Figure 4:
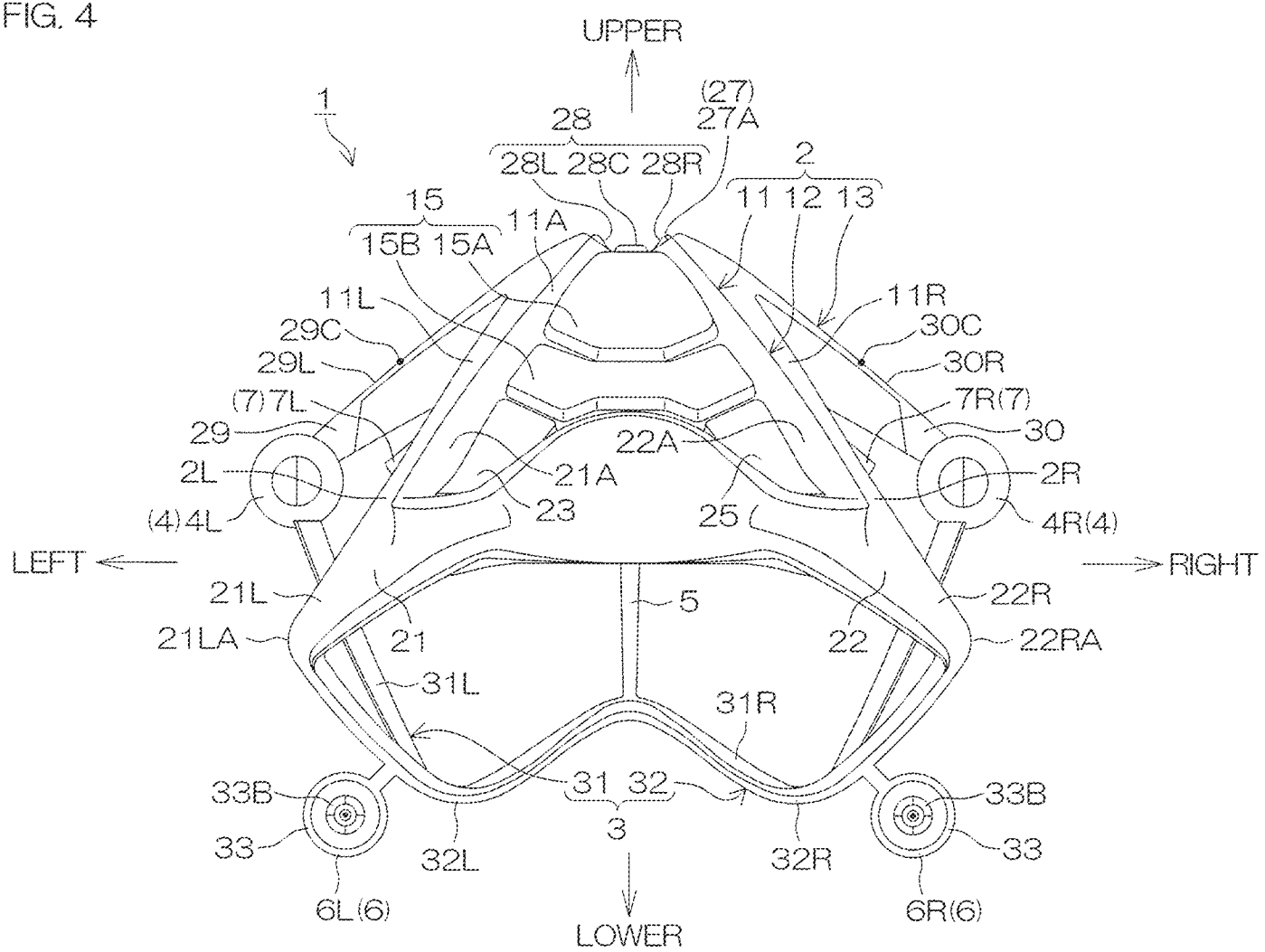
FIG. 4 is a rear view of the hydrofoil craft.

Preferred embodiments of the present invention will be hereinafter described in detail with reference to the accompanying drawings. FIG. 1 is a perspective view of a hydrofoil craft 1 according to a preferred embodiment of the present invention. In the following description, a front-rear direction, a right-left direction, and an up-down direction are directions defined on the basis of the point of view of a vessel operator following a traveling direction of the hydrofoil craft 1 while riding on the hydrofoil craft 1 floating on a water surface. The right-left direction is a width direction of the hydrofoil craft 1. FIG. 2, FIG. 3, and FIG. 4 are respectively a plan view, a left side view, and a rear view of the hydrofoil craft 1.

Referring mainly to FIG. 1, the hydrofoil craft 1 in the present preferred embodiment is a single-person hydrofoil craft for leisure. The maximum speed of the hydrofoil craft 1 is restricted to, for example, 20 km/h or less so that a vessel operator is able to operate the hydrofoil craft 1 without a special license. The hydrofoil craft 1 is small, and is transported to a destination while being loaded on a loading platform of a vehicle, such as an SUV (Sport Utility Vehicle).

The hydrofoil craft 1 includes a deck 2 by which the vessel operator is supported, a hydrofoil 3 disposed below the deck 2, and a float 4 that is disposed both at the deck 2 and at the hydrofoil 3 and that generates a buoyant force. The hydrofoil craft 1 additionally includes a reinforcing portion 5 that connects the deck 2 and the hydrofoil 3 together, a thruster 6 that generates a thrust, and a thrust operator 7 that is operated by the vessel operator to adjust the thrust of the thruster 6.

The deck 2 preferably has the shape of the letter X in a plan view that resembles a silhouette of the vessel operator when spreading his/her hands and feet. The deck 2 is preferably laterally symmetrical with respect to its center J (see FIG. 2) in the right-left direction. Likewise, other laterally-symmetrical components described below are also preferably laterally symmetrical with respect to the center J. The deck 2 includes a central-portion (hereafter referred to as a chest placing portion 11) on which a chest, etc., of the vessel operator are placed, a rear portion (hereafter referred to as a lower-limb placing portion 12) that is disposed at a more rearward position than the chest placing portion 11 and on which lower limbs of the vessel operator are placed, and a forward portion (hereafter referred to as an upper-limb placing portion 13) that is disposed at a more forward position than the chest placing portion 11 and on which upper limbs of the vessel operator are placed.

The chest placing portion 11 is positioned substantially at the center of the deck 2 in the front-rear direction and in the right-left direction. The chest placing portion 11 has a concave-shaped upper surface 11A, a left side surface 11L that is tilted leftward and downward from a left end of the upper surface 11A, and a right side surface 11R that is tilted rightward and downward from a right end of the upper surface 11A. The upper surface 11A has a substantially U-shaped transverse plane, and is tilted more downwardly and increasingly spreads rightwardly and leftwardly as it extends toward a rear end of the upper surface 11A (see FIG. 4). The upper surface 11A is provided with a flat or substantially flat cushion 15 that is made of an elastic material such as a sponge material, for example. The cushion 15 in the present preferred embodiment includes a substantially equilateral trapezoidal chest cushion 15A that is laterally symmetrical and a substantially H-shaped belly cushion 15B that is disposed at a more rearward position than the chest cushion 15A and that is laterally symmetrical. The number of the cushions 15 and the shape of each cushion 15 can be arbitrarily changed.

The lower-limb placing portion 12 includes a left-rear portion (hereafter referred to as a left-leg placing portion 21) on which a left leg of the vessel operator is placed and a right-rear portion (hereafter referred to as a right-leg placing portion 22) that is disposed at a more rightward position than the left-leg placing portion 21 and on which a right leg of the vessel operator is placed, and the lower-limb placing portion 12 preferably has the shape of the letter V that increasingly spreads rightwardly and leftwardly as it extends towards its rear end in a plan view (see FIG. 2). Therefore, a distance between the left-leg placing portion 21 and the right-leg placing portion 22 becomes greater as they extend rearward from the chest placing portion 11, and the left-leg placing portion 21 and the right-leg placing portion 22 are arranged laterally symmetrically.

The left-leg placing portion 21 has a concave-shaped upper surface 21A and a left side surface 21L that is tilted leftward and downward from a left end of the upper surface 21A. The upper surface 21A has a substantially U-shaped transverse plane, and continuously extends leftward and rearward from a left rear end of the upper surface 11A of the chest placing portion 11. A through-hole 21B that extends through the left-leg placing portion 21 in the up-down direction is provided in a rear end portion of the upper surface 21A. The left side surface 21L extends while continuously spreading downwardly from a rear end of the left side surface 11L of the chest placing portion 11. A left lower edge 21LA of the left side surface 21L defines a left end portion of the lower-limb placing portion 12. A flat or substantially flat left-leg cushion 23 that is made of an elastic material, such as a sponge material, for example, and that is elongated in the front-rear direction is disposed on the upper surface 21A. In the left-leg placing portion 21, a flat or substantially flat left-sole cushion 24 that is made of an elastic material, such as a sponge material, for example, is disposed on a longitudinal plane that defines the through-hole 21B from the rear side. The number of the left-leg cushions 23 and the shape of each of the left-leg cushions 23 can be arbitrarily set. The same applies to the left-sole cushion 24.

The right-leg placing portion 22 has a concave-shaped upper surface 22A and a right side surface 22R (see FIG. 2) that is tilted rightward and downward from a right end of the upper surface 22A. The upper surface 22A has a substantially U-shaped transverse plane, and continuously extends rightward and rearward from a right rear end of the upper surface 11A of the chest placing portion 11. A through-hole 22B that extends through the right-leg placing portion 22 in the up-down direction is provided in a rear end portion of the upper surface 22A. The right side surface 22R extends while continuously spreading downwardly from a rear end of the right side surface 11R of the chest placing portion 11. A right lower edge 22RA (see FIG. 2) of the right side surface 22R defines a right end portion of the lower-limb placing portion 12. A flat or substantially flat right-leg cushion 25 that is made of an elastic material, such as a sponge material, for example, and that is elongated in the front-rear direction is disposed on the upper surface 22A. In the right-leg placing portion 22, a flat or substantially flat right-sole cushion 26 that is made of an elastic material, such as a sponge material, for example, is disposed on a longitudinal plane that defines the through-hole 22B from the rear side. The number of the right-leg cushions 25 and the shape of each of the right-leg cushions 25 can be arbitrarily set. The same applies to the right-sole cushion 26. The left-leg cushion 23 and the right-leg cushion 25 are disposed laterally symmetrically, and the left-sole cushion 24 and the right-sole cushion 26 are disposed laterally symmetrically.

The deck 2 includes an additional portion (hereafter referred to as a head placing portion 27) that is disposed at a more forward position than the chest placing portion 11 and on which a head of the vessel operator is placed. The head placing portion 27 has a concave-shaped upper surface 27A. The upper surface 27A has a substantially U-shaped transverse plane, and is tilted more downwardly as it extends towards its front end continuously from a front end of the upper surface 11A of the chest placing portion 11. A flat or substantially flat head cushion 28 that is made of an elastic material, such as a sponge material, for example, is disposed on the upper surface 27A. The head cushion 28 of the present preferred embodiment includes a substantially triangular central head cushion 28C that is laterally symmetrical and that becomes thinner as it extends toward its front end, and both a left head cushion 28L and a right head cushion 28R that are disposed laterally symmetrically with the central head cushion 28C between the left head cushion 28L and the right head cushion 28R. The number of the head cushions 28 and the shape of each of the head cushions 28 can be arbitrarily changed.

The upper-limb placing portion 13 includes a left-forward portion (hereafter referred to as a left-arm placing portion 29) that is disposed at a more leftward position than the head placing portion 27 and on which a left arm of the vessel operator is placed, and a right-forward portion (hereafter referred to as a right-arm placing portion 30) that is disposed at a more rightward position than the head placing portion 27 and on which a right arm of the vessel operator is placed. The upper-limb placing portion 13 preferably has the shape of the letter V that increasingly spreads rightwardly and leftwardly as it extends toward its front end in a plan view (see FIG. 2). Therefore, a distance between the left-arm placing portion 29 and the right-arm placing portion 30 becomes greater as they extend forward from the chest placing portion 11, and the left-arm placing portion 29 and the right-arm placing portion 30 are arranged laterally symmetrically. The left-arm placing portion 29 and the right-arm placing portion 30 are tilted more downwardly as they extend forward from the chest placing portion 11 (see FIG. 3).

The left-arm placing portion 29 includes a left side surface 29L that is tilted leftward and downward, and a right side surface 29R (see FIG. 2) that is tilted rightward and downward from a right end of the left side surface 29L. The left side surface 29L extends while continuously descending leftward and forward from a front end of the left side surface 11L of the chest placing portion 11. The left side surface 29L, the left side surface 11L, and the left side surface 21L of the left-leg placing portion 21 define a reverse V-shaped left side surface 2L in the deck 2. A left lower edge 29LA of the left side surface 29L defines a left-side outer edge of the deck 2, i.e., more specifically, defines a left end portion of the upper-limb placing portion 13. The right side surface 29R extends while continuously descending leftward and forward from a left front end of the upper surface 27A of the head placing portion 27.

The right-arm placing portion 30 includes a right side surface 30R that is tilted rightward and downward, and a left side surface 30L that is tilted leftward and downward from a left end of the right side surface 30R. The right side surface 30R extends while continuously descending rightward and forward from a front end of the right side surface 11R of the chest placing portion 11. The right side surface 30R, the right side surface 11R, and the right side surface 22R of the right-leg placing portion 22 define a reverse V-shaped right side surface 2R in the deck 2. A right lower edge 30RA of the right side surface 30R defines a right-side outer edge of the deck 2, i.e., more specifically, defines a right end portion of the upper-limb placing portion 13. The left side surface 30L extends while continuously descending rightward and forward from a right front end of the upper surface 27A of the head placing portion 27.

The hydrofoil 3 includes a front hydrofoil 31 and a rear hydrofoil 32 disposed at a more rearward position than the front hydrofoil 31. The front hydrofoil 31 connects the left lower edge 29LA of the left-arm placing portion 29 and the right lower edge 30RA of the right-arm placing portion 30 together. The rear hydrofoil 32 connects the left lower edge 21LA of the left-leg placing portion 21 and the right lower edge 22RA of the right-leg placing portion 22 together.

The front hydrofoil 31 is tilted more downwardly as it extends toward its rear end from the left lower edge 29LA of the left-arm placing portion 29 and from the right lower edge 30RA of the right-arm placing portion 30 (see FIG. 3). The front hydrofoil 31 includes a rearward end 100 (see FIGS. 3, 5, and 6). The front hydrofoil 31 includes a left portion 31L that first extends rightward and downward from the left lower edge 29LA of the left-arm placing portion 29 and then extends rightward and upward, and a right portion 31R that first extends leftward and downward from the right lower edge 30RA of the right-arm placing portion 30 and then extends leftward and upward (see FIG. 4). In other words, the left portion 31L and the right portion 31R each preferably have the shape of the letter V. A right end of the left portion 31L and a left end of the right portion 31R are connected together, and therefore the front hydrofoil 31 preferably has the shape of the letter W in a front view or in a rear view (see FIG. 4).

The rear hydrofoil 32 is tilted more downwardly as it extends toward its front end from the left lower edge 21LA of the left-leg placing portion 21 and from the right lower edge 22RA of the right-leg placing portion 22 (see FIG. 3). The front hydrofoil 31 includes a left portion 32L that first extends rightward and downward from the left lower edge 21LA of the left-leg placing portion 21 and then extends rightward and upward, and a right portion 32R that first extends leftward and downward from the right lower edge 22RA of the right-arm placing portion 30 and then extends leftward and upward (see FIG. 4). In other words, the left portion 32L and the right portion 32R each preferably have the shape of the letter V. A right end of the left portion 32L and a left end of the right portion 32R are connected together, and therefore the rear hydrofoil 32 preferably has the shape of the letter W in a front view or in a rear view (see FIG. 4).

An age limit is not set for the vessel operator of the hydrofoil craft 1, and therefore the hydrofoil craft 1 has been created for vessel operators who are users, which include children, in a wide age range. Therefore, in the hydrofoil 3, a plurality of sizes exist in accordance with the physique of a vessel operator. Each hydrofoil 3 has a size such that it is attachable to and detachable from the deck 2 by, for example, a snap fit without using tools. When the hydrofoil 3 is detached from the deck 2, the hydrofoil 3 is separated from the left lower edge 29LA of the left-arm placing portion 29, from the right lower edge 30RA of the right-arm placing portion 30, from the left lower edge 21LA of the left-leg placing portion 21, and from the right lower edge 22RA of the right-leg placing portion 22.

The float 4 includes a central float 4C defining a lower portion of the deck 2, a left float 4L defining a connection portion between the left-arm placing portion 29 and the left portion 31L of the front hydrofoil 31, and a right float 4R defining a connection portion between the right-arm placing portion 30 and the right portion 31R of the front hydrofoil 31. The central float 4C is preferably a hollow body that has a downwardly convex curved lower surface, and is disposed below the chest placing portion 11 and the head placing portion 27. The left float 4L and the right float 4R are each preferably a cylindrical hollow body that extends in the front-rear direction, and are disposed laterally symmetrically at a more forward position than the central float 4C. When the hydrofoil 3 is detached from the deck 2, the left float 4L and the right float 4R may be detached together with the hydrofoil 3, or may remain fixed to the deck 2.

The reinforcing portion 5 extends frontward and downward from the central float 4C, and is connected to the connection portion between the left portion 31L and the right portion 31R in the front hydrofoil 31 (see FIG. 4).

The thruster 6 includes a left and right pair of thrusters 6L and 6R. The thruster 6L and the thruster 6R are respectively disposed at positions at which the thrusters 6L and 6R are always in the water. More specifically, the thruster 6L is attached to the left portion 32L of the rear hydrofoil 32, and the thruster 6R is attached to the right portion 32R of the rear hydrofoil 32. Each of the thrusters 6L and 6R includes a cylindrical housing 33 that extends in the front-rear direction, an impeller 34 disposed in the housing 33, and an electric motor 35 that is disposed in the housing 33 and that rotates the impeller 34. A suction opening 33A through which water is sucked into the housing 33 is provided in the front surface of the housing 33, and a jet opening 33B (see FIG. 4) through which water sucked in the housing 33 is jetted rearwardly is provided in a rear surface of the housing 33. The electric motor 35 operates, and, accordingly, the impeller 34 rotates. As a result, in the thruster 6, surrounding water is sucked into the housing 33 and is jetted rearwardly from the jet opening 33B, and thus a jet propulsion force that advances the hydrofoil craft 1 is generated. The maximum power of the electric motor 35 is set at, for example, a low power output of about 1.5 kW in accordance with the maximum speed of the hydrofoil craft 1.

The hydrofoil craft 1 additionally includes a power generator 41 that generates electric power by which the electric motor 35 is operated, and the power generator 41 is located in a central area 2C in the right-left direction of the deck 2 (see FIG. 2). The central area 2C overlaps with the chest placing portion 11 in a plan view. An example of the power generator 41 is a battery. A user, such as a vessel operator, is able to access the power generator 41 by detaching the cushion 15 from the deck 2, and is able to charge or replace the power generator 41 with another. A watertight socket (not shown) may be provided on a surface of the deck 2, and the power generator 41 disposed in the deck 2 may be charged with electricity by connecting a feeder cable to the socket.

The thrust operator 7 includes a left thrust operator 7L disposed at the left-arm placing portion 29 and a right thrust operator 7R disposed at the right-arm placing portion 30. The left thrust operator 7L and the right thrust operator 7R are disposed laterally symmetrically. In a vertical direction, the left thrust operator 7L is disposed below a center 29C of the left-arm placing portion 29, and the right thrust operator 7R is disposed below a center 30C of the right-arm placing portion 30 (see FIG. 4). The left thrust operator 7L and the right thrust operator 7R each include a grip 42 that extends outwardly from the deck 2 in the right-left direction and a lever 43 disposed, for example, in front of the grip 42 (see FIG. 3).

The left thrust operator 7L corresponds to a first thruster of the left and right pair of thrusters 6L and 6R, and the right thrust operator 7R corresponds to a second thruster of the left and right pair of thrusters 6L and 6R. In the present preferred embodiment, the thruster 6L of the left and right pair of thrusters 6L and 6R is a first thruster, and the thruster 6R of the left and right pair of thrusters 6L and 6R is a second thruster. The vessel operator causes the thruster 6L to generate a thrust by pulling the lever 43 of the left thrust operator 7L while grasping the grip 42 of the left thrust operator 7L, and is able to adjust the thrust of the thruster 6L by adjusting the pulling amount of the lever 43. The vessel operator causes the thruster 6R to generate a thrust by pulling the lever 43 of the right thrust operator 7R while grasping the grip 42 of the right thrust operator 7R, and is able to adjust the thrust of the thruster 6R by adjusting the pulling amount of the lever 43. As an arrangement opposite to that of the present preferred embodiment, the thruster 6R may be a first thruster, and the thruster 6L may be a second thruster. If so, the thrust of the thruster 6R is adjusted by the vessel operator operating the left thrust operator 7L, and the thrust of the thruster 6L is adjusted by the vessel operator operating the right thrust operator 7R.

Figure 5:
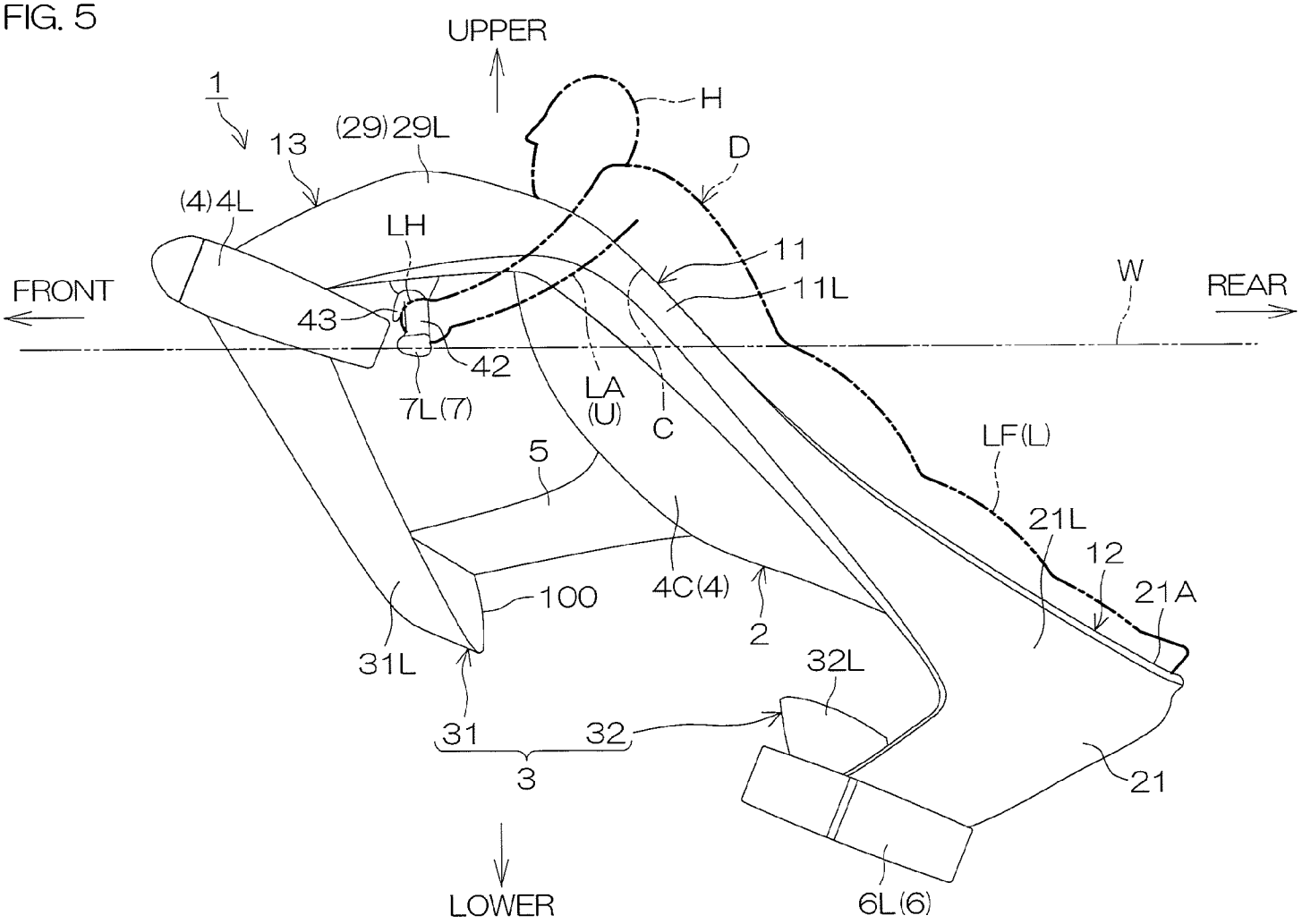
FIG. 5 is a left side view of the hydrofoil craft when a vessel operator rides on or dismounts from the hydrofoil craft.
Figure 6:
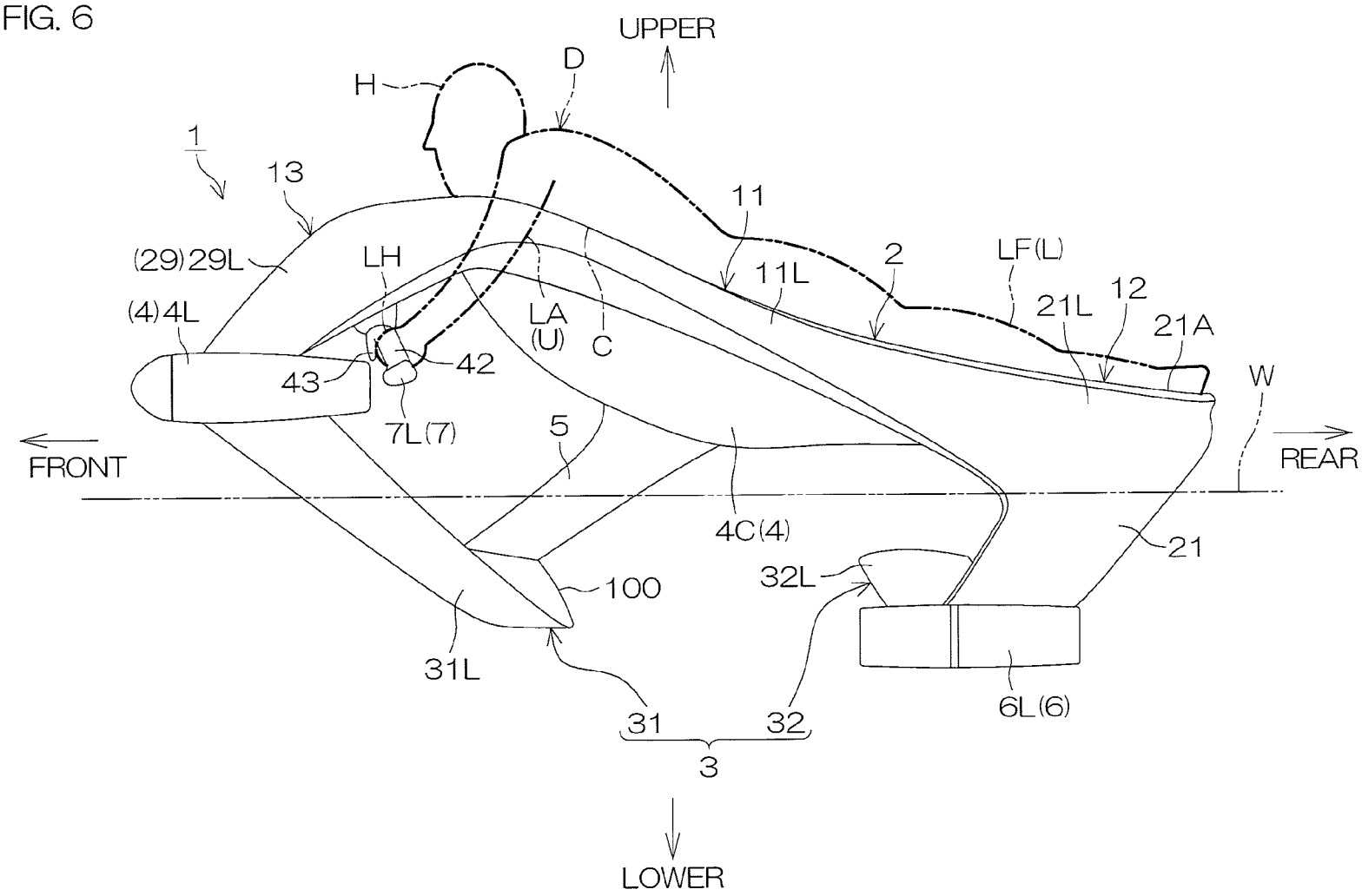
FIG. 6 is a left side view of the hydrofoil craft that is traveling.

FIG. 5 is a left side view of the hydrofoil craft 1 when the vessel operator rides on or dismounts from the hydrofoil craft 1. In the hydrofoil craft 1, the float 4 that generates a buoyant force is disposed nearer to the front, and the thruster 6 that is comparatively heavy is disposed nearer to the rear. Therefore, while the hydrofoil craft 1 has stopped on the water surface W, the hydrofoil craft 1 assumes a posture in which the rear side is lower than the front side so that the lower-limb placing portion 12 is positioned below the water surface W and so that the upper-limb placing portion 13 is positioned above the water surface W. The vessel operator D rides on the deck 2 of the hydrofoil craft 1 in a prone position so that the upper half of the body of the vessel operator D is positioned above the water surface W whereas the lower half of the body of the vessel operator D is positioned below the water surface W. The vessel operator D causes the thruster 6L to generate a thrust by operating the left thrust operator 7L with the left hand LH, and causes the thruster 6R to generate a thrust by operating the right thrust operator 7R with the right hand RH (see FIG. 8 described later), and, accordingly, the hydrofoil craft 1 moves. Thus, the front hydrofoil 31 and the rear hydrofoil 32 generate a lift force, and therefore the entirety of the deck 2 on which the vessel operator D rides floats on the water surface W as shown in FIG. 6. The width of the reinforcing portion 5, which is in the water together with the front hydrofoil 31 and the rear hydrofoil 32 while the hydrofoil craft 1 is traveling, becomes narrower as it extends toward a front end of the reinforcing portion 5. More specifically, the horizontal section of the reinforcing portion 5 has an airfoil shape. Thus, the resistance of the reinforcing portion 5 against the water becomes smaller.

Figure 7:
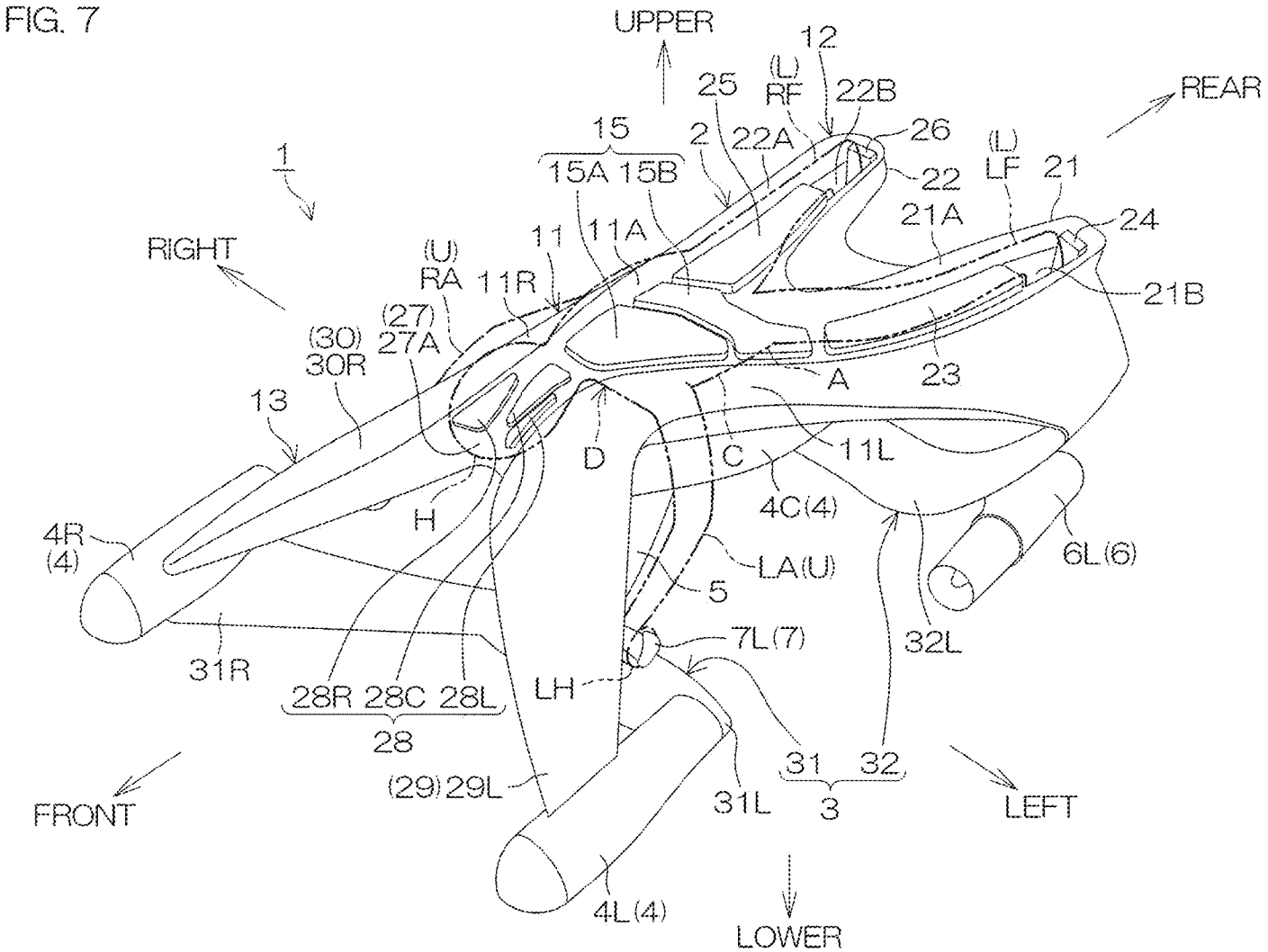
FIG. 7 is a perspective view of the hydrofoil craft that is traveling.
Figure 8:
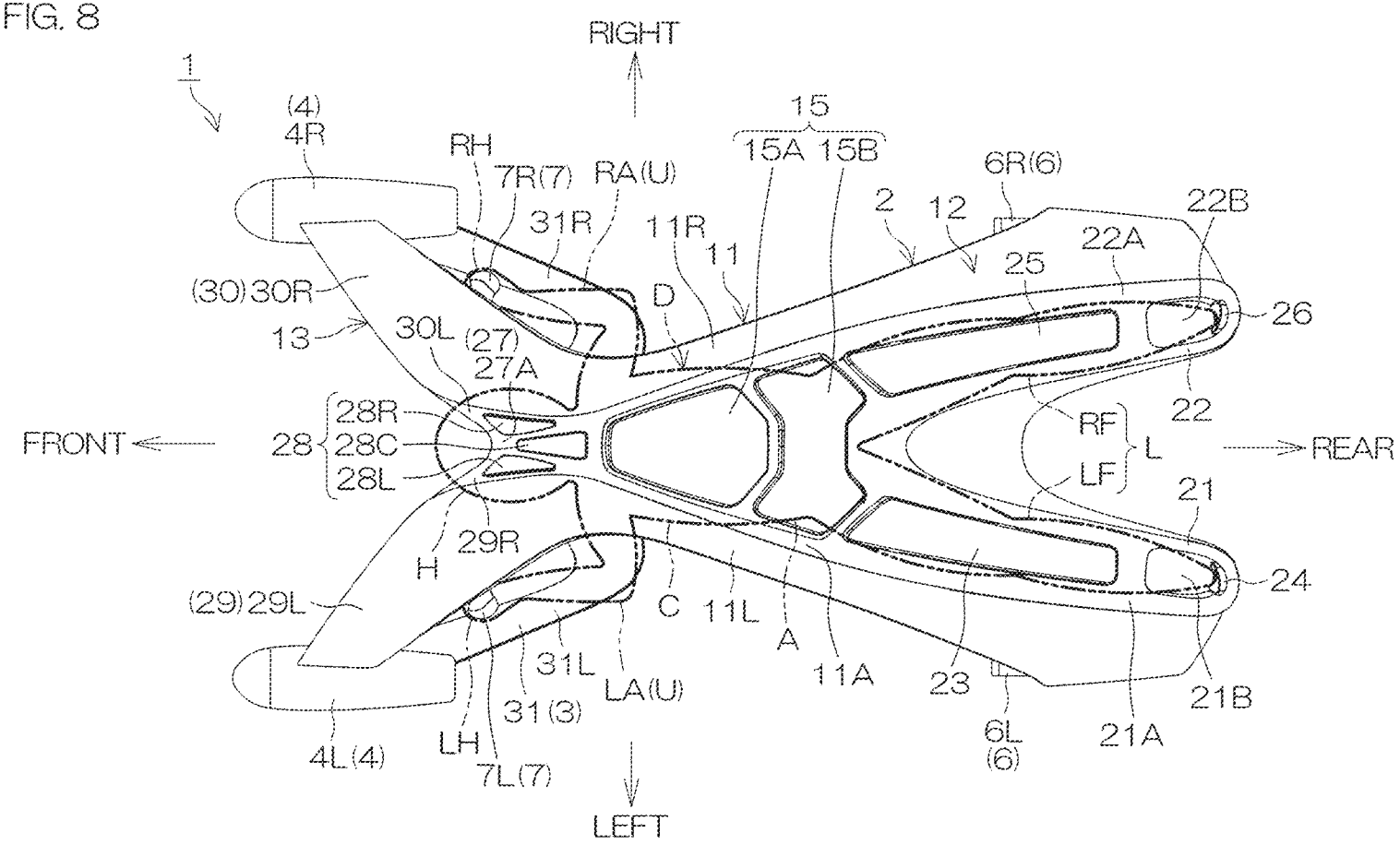
FIG. 8 is a plan view of the hydrofoil craft that is traveling.

FIG. 7 is a perspective view of the hydrofoil craft 1 that is traveling while being operated by the vessel operator D. FIG. 8 is a plan view of the hydrofoil craft 1 that is traveling while being operated by the vessel operator D. The vessel operator D operating the craft is riding on the deck 2 in a prone position, and his/her chest C and his/her belly A are placed on the chest placing portion 11, and his/her lower limb L is placed on the lower-limb placing portion 12, and his/her upper limb U is placed on the upper-limb placing portion 13. The concave-shaped upper surface 11A in the chest placing portion 11 extends along at least a portion of the chest C and at least a portion of the belly A. The chest cushion 15A disposed on the upper surface 11A supports the chest C from below, and the belly cushion 15B disposed on the upper surface 11A supports the belly A from below.

The vessel operator D places the left leg LF of the lower limb L on the left-leg placing portion 21, and inserts the tiptoe of the left leg LF in the through-hole 21B in the rear end portion of the left-leg placing portion 21. The concave-shaped upper surface 21A in the left-leg placing portion 21 extends along at least a portion of the left leg LF. The left-leg cushion 23 disposed on the upper surface 21A supports the left leg LF from below, and the left-sole cushion 24 disposed at the through-hole 21B supports the sole of the left leg LF from the rear. The vessel operator D places the right leg RF of the lower limb L on the right-leg placing portion 22, and inserts the tiptoe of the right leg RF in the through-hole 22B of the rear end portion of the right-leg placing portion 22. The concave-shaped upper surface 22A in the right-leg placing portion 22 extends along at least a portion of the right leg RF. The right-leg cushion 25 disposed on the upper surface 22A supports the right leg RF from below, and the right-sole cushion 26 disposed at the through-hole 22B supports the sole of the right leg RF from the rear. A long-legged vessel operator D may operate the craft such that the kneecap of the left leg LF is fitted into the through-hole 21B of the left-leg placing portion 21, and the kneecap of the right leg RF is fitted into the through-hole 22B of the right-leg placing portion 22, and the shank of the left leg LF and the shank of the right leg RF protrude rearwardly from the deck 2.

In a state in which at least the base of the left arm LA of the upper limb U is placed on the left side surface 29L of the left-arm placing portion 29, the vessel operator D protrudes the elbow of the left arm LA leftwardly from the left side surface 29L, and places the left hand LH below the left-arm placing portion 29, and operates the left thrust operator 7L with the left hand LH. The left side surface 29L extends along at least a portion of the left arm LA (in the present preferred embodiment, the base of the left arm LA).

In a state in which at least the base of the right arm RA of the upper limb U is placed on the right side surface 30R of the right-arm placing portion 30, the vessel operator D protrudes the elbow of the right arm RA rightwardly from the right side surface 30R, and places the right hand RH below the right-arm placing portion 30, and operates the right thrust operator 7R with the right hand RH. The right side surface 30R extends along at least a portion of the right arm RA (in the present preferred embodiment, the base of the right arm RA).

The vessel operator D may place his/her head H on the head placing portion 27. In that case, the concave-shaped upper surface 27A in the head placing portion 27 extends along at least a portion (for example, the jaw or cheek) of the head H, and each head cushion 28 in the upper surface 27A supports the head H from below. The vessel operator D may operate the craft in a state of lifting the head H from the head placing portion 27. In any case, the direction of the head H, i.e., the direction of the sight line of the vessel operator D coincides with the traveling direction of the hydrofoil craft 1.

As described above, according to the structural arrangement of the present preferred embodiment, the vessel operator D places the chest C on the chest placing portion 11, and places the lower limb L on the lower-limb placing portion 12, and thus rides on the deck 2 of the hydrofoil craft 1 in a prone position. Therefore, the line of sight of the vessel operator D is near the water surface W on the front side, and therefore the vessel operator D easily feels a speed difference between himself/herself and the water surface W (see FIG. 6). This makes it possible to provide a feeling of speed to the vessel operator D even if the hydrofoil craft 1 cannot travel at a high speed because of, for example, the fact that the output of the thruster 6 is limited. Additionally, it is possible for the vessel operator D to control the speed by adjusting the thrust of the thruster 6 while operating the thrust operator 7.

In the present preferred embodiment, the chest placing portion 11 has a shape extending along at least a portion of the chest C of the vessel operator D, and the lower-limb placing portion 12 has a shape extending along at least a portion of the lower limb L of the vessel operator D. According to this structural arrangement, the position of the chest C placed on the chest placing portion 11 and the position of the lower limb L placed on the lower-limb placing portion 12 are stabilized, thus enabling the vessel operator D to ride on the hydrofoil craft 1 in a stable posture and to feel and/or control its speed.

In the present preferred embodiment, the lower-limb placing portion 12 includes the left-leg placing portion 21 on which the left leg LF of the vessel operator D is placed, and the right-leg placing portion 22 that is disposed at a more rightward position than the left-leg placing portion 21 and on which the right leg RF of the vessel operator D is placed. According to this structural arrangement, the vessel operator D places the left leg LF on the left-leg placing portion 21 and places the right leg RF on the right-leg placing portion 22, thus enabling the vessel operator D to ride on the hydrofoil craft 1 in a stable posture and to feel and/or control its speed.

In the present preferred embodiment, a distance between the left-leg placing portion 21 and the right-leg placing portion 22 becomes greater as they extend rearward from the chest placing portion 11. This structural arrangement enables the vessel operator D to ride on the hydrofoil craft 1 in a posture in which his/her left and right legs are widened leftwardly and rightwardly and to feel and/or control its speed.

In the present preferred embodiment, the left-leg placing portion 21 and the right-leg placing portion 22 are arranged laterally symmetrical. This structural arrangement enables the vessel operator D to ride on the hydrofoil craft 1 in a stable posture by extending his/her left and right legs laterally symmetrically and to feel and/or control its speed.

In the present preferred embodiment, the upper surface 11A of the chest placing portion 11 has a concave shape, and, in the lower-limb placing portion 12, the upper surface 21A of the left-leg placing portion 21 and the upper surface 22A of the right-leg placing portion 22 each have a concave shape. According to this structural arrangement, the chest C is placed on the concave-shaped upper surface 11A in the chest placing portion 11. Additionally, the left leg LF is placed on the concave-shaped upper surface 21A in the left-leg placing portion 21, and/or the right leg RF is placed on the concave-shaped upper surface 22A of the right-leg placing portion 22. Thus, the posture of the vessel operator D is stabilized. This enables the vessel operator D to ride on the hydrofoil craft 1 in a stable posture and to feel and/or control its speed. As long as the posture of the vessel operator D is stabilized, all of the upper surface 11A of the chest placing portion 11, the upper surface 21A of the left-leg placing portion 21, and the upper surface 22A of the right-leg placing portion 22 are not necessarily required to have a concave shape.

In the present preferred embodiment, the upper surface 11A of the chest placing portion 11 is tilted more downwardly as it extends toward its rear end. This structural arrangement enables the vessel operator D whose chest C is placed on the upper surface 11A of the chest placing portion 11 to ride on the hydrofoil craft 1 in a stable posture without falling forwardly and to feel and/or control its speed (see FIG. 6).

In the present preferred embodiment, the vessel operator D places the upper limb U on the upper-limb placing portion 13, thus enabling the vessel operator D to ride on the hydrofoil craft 1 in a posture in which the left arm LA and the right arm RA are stretched forwardly and to feel and/or control its speed.

In the present preferred embodiment, the upper-limb placing portion 13 has a shape extending along at least a portion of the upper limb U of the vessel operator D. According to this structural arrangement, the position of the upper limb U placed on the upper-limb placing portion 13 is stabilized, thus enabling the vessel operator D to ride on the hydrofoil craft 1 in a stable posture and to feel and/or control its speed.

In the present preferred embodiment, the upper surface 27A of the head placing portion 27 has a concave shape. According to this structural arrangement, the posture of the vessel operator D is stabilized by placing the head H of the vessel operator D on the concave-shaped upper surface 27A in the upper-limb placing portion 13. This enables the vessel operator D to ride on the hydrofoil craft 1 in a stable posture and to feel and/or control its speed.

In the present preferred embodiment, the upper-limb placing portion 13 includes the left-arm placing portion 29 on which the left arm LA of the vessel operator D is placed and the right-arm placing portion 30 that is disposed at a more rightward position than the left-arm placing portion 29 and on which the right arm RA of the vessel operator D is placed. According to this structural arrangement, the vessel operator D places the left arm LA on the left-arm placing portion 29 and places the right arm RA on the right-arm placing portion 30, thus enabling the vessel operator D to ride on the hydrofoil craft 1 in a posture in which the left and right arms are stretched forwardly and to feel and/or control its speed.

In the present preferred embodiment, a distance between the left-arm placing portion 29 and the right-arm placing portion 30 becomes greater as they extend forward from the chest placing portion 11. This structural arrangement enables the vessel operator D to ride on the hydrofoil craft 1 in a posture in which his/her left and right arms are stretched forwardly and are widened leftwardly and rightwardly and to feel and/or control its speed.

In the present preferred embodiment, the left-arm placing portion 29 and the right-arm placing portion 30 are arranged laterally symmetrically. According to this structural arrangement, the vessel operator D laterally symmetrically extends the left and right arms, thus enabling the vessel operator D to ride on the hydrofoil craft 1 in a stable posture and to feel and/or control its speed.

In the present preferred embodiment, the left side surface 29L of the left-arm placing portion 29 has a shape extending along at least a portion of the left arm LA of the vessel operator D, and the right side surface 30R of the right-arm placing portion 30 has a shape extending along at least a portion of the right arm RA of the vessel operator D. According to this structural arrangement, the position of the left arm LA placed on the left-arm placing portion 29 and the position of the right arm RA placed on the right-arm placing portion 30 are stabilized, thus enabling the vessel operator D to ride on the hydrofoil craft 1 in a stable posture and to feel and/or control its speed.

In the present preferred embodiment, the vessel operator D adjusts the thrust of the thruster 6 by at least one of the operation of the left thrust operator 7L with the left hand LH and the operation of the right thrust operator 7R with the right hand RH, thus enabling the vessel operator D to control the speed of the hydrofoil craft 1.

In the present preferred embodiment, in the vertical direction, the left thrust operator 7L is disposed below the center 29C of the left-arm placing portion 29, and the right thrust operator 7R is disposed below the center 30C of the right-arm placing portion 30. This structural arrangement makes it possible to dispose both the left thrust operator 7L and the right thrust operator 7R below the sight line of the vessel operator D. In this case, it becomes difficult for both the left thrust operator 7L and the right thrust operator 7R to enter the field of vision of the vessel operator D, and therefore the vessel operator D more easily feels a speed difference between himself/herself and the water surface W. This makes it possible to more greatly provide a feeling of speed to the vessel operator D.

In the present preferred embodiment, the left thrust operator 7L and the right thrust operator 7R are disposed laterally symmetrically. According to this structural arrangement, the left hand LH and the right hand RH of the vessel operator D respectively operating the left thrust operator 7L and the right thrust operator 7R are disposed laterally symmetrically, thus enabling the vessel operator D to ride on the hydrofoil craft 1 in a stable posture and to feel and/or control its speed.

In the present preferred embodiment, the thrust of the first thruster 6 of the left and right pair of thrusters 6L and 6R is adjusted by the vessel operator D operating the left thrust operator 7L, and the thrust of the second thruster 6 of the left and right pair of thrusters 6L and 6R is adjusted by the vessel operator D operating the right thrust operator 7R. According to this structural arrangement, the vessel operator D operates the left thrust operator 7L and the right thrust operator 7R, and adjusts the thrust of the first thruster 6 and the thrust of the second thruster 6, thus enabling the vessel operator D to control the craft's speed and/or posture. Additionally, the vessel operator D operates at least one of the left thrust operator 7L and the right thrust operator 7R so as to make a difference between the thrust of the first thruster 6 and the thrust of the second thruster 6, thus making it possible to turn the hydrofoil craft 1 rightwardly or leftwardly.

In the present preferred embodiment, the front hydrofoil 31 of the hydrofoil 3 tilts more downwardly from the outer edge of the deck 2 as it extends toward a rear end of the front hydrofoil 31. According to this structural arrangement, it is possible to achieve an arrangement that enables the vessel operator D to receive a feeling of speed and that enables the vessel operator D to control the speed while enabling the hydrofoil craft 1 to become more compact in the front-rear direction than in a case in which the front hydrofoil 31 extends forwardly.

In the present preferred embodiment, the front hydrofoil 31 tilts more downwardly as it extends towards its rear end from the right and left end portions of the upper-limb placing portion 13. According to this structural arrangement, it is possible to achieve an arrangement that enables the vessel operator D to receive a feeling of speed and that enables the vessel operator D to control the speed while enabling the hydrofoil craft 1 to become more compact in the front-rear direction than in a case in which the front hydrofoil 31 extends forwardly from the end portions of the upper-limb placing portion 13.

In the present preferred embodiment, both the left-arm placing portion 29 and the right-arm placing portion 30 are tilted more downwardly as they extend forward from the chest placing portion 11. The front hydrofoil 31 connects the left lower edge 29LA of the left-arm placing portion 29 and the right lower edge 30RA of the right-arm placing portion 30 together. This structural arrangement makes it possible to dispose the left arm LA placed on the left-arm placing portion 29 and the right arm RA placed on the right-arm placing portion 30 below the sight line of the vessel operator D. In this case, it becomes difficult for both the left arm LA and the right arm RA of the vessel operator D to enter the field of vision of the vessel operator D, and therefore the vessel operator D more easily feels a speed difference between himself/herself and the water surface W. This makes it possible to more greatly provide a feeling of speed to the vessel operator D. Additionally, the hydrofoil 3 connects the left lower edge 29LA of the left-arm placing portion 29 and the right lower edge 30RA of the right-arm placing portion 30 together, thus making it possible to reinforce these arm placing portions.

In the present preferred embodiment, the front hydrofoil 31 includes the left portion 31L that first extends rightward and downward from the left lower edge 29LA of the left-arm placing portion 29 and then extends rightward and upward, and the right portion 31R that first extends leftward and downward from the right lower edge 30RA of the right-arm placing portion 30 and then extends leftward and upward. According to this structural arrangement, the left portion 31L and the right portion 31R each preferably have the shape of the letter V, and the front hydrofoil 31 that has these laterally-disposed portions contributes to stabilizing the posture of the hydrofoil craft 1. This makes it possible to achieve an arrangement that enables the vessel operator D to receive a feeling of speed and that enables the vessel operator D to control the speed while enabling the hydrofoil craft 1 to stably travel.

In the present preferred embodiment, it is possible to achieve an arrangement that enables the vessel operator D to receive a feeling of speed and that enables the vessel operator D to control the speed while reinforcing the deck 2 and the front hydrofoil 31 by the reinforcing portion 5 that extends downwardly from the deck 2 and that is connected to the front hydrofoil 31.

In the present preferred embodiment, the hydrofoil 3 includes the rear hydrofoil 32 disposed at a more rearward position than the front hydrofoil 31. According to this structural arrangement, it is possible to achieve an arrangement that enables the vessel operator D to receive a feeling of speed and that enables the vessel operator D to control the speed while enabling the hydrofoil craft 1 to stably travel by the front hydrofoil 31 and the rear hydrofoil 32 that are spaced apart in the front-rear direction.

In the present preferred embodiment, the thruster 6 is disposed at the hydrofoil 3, and therefore it is possible to dispose the thruster 6 at a submerged position without separately using a holding member such as a bracket. Particularly, if the thruster 6 is attached to the rear hydrofoil 32, water that is forced out rearwardly by a thrust generated by the thruster 6 does not easily disturb a water flow around the front hydrofoil 31 and the rear hydrofoil 32, and therefore the function of the front hydrofoil 31 and the function of the rear hydrofoil 32 are not encumbered.

In the present preferred embodiment, the hydrofoil 3 is attachable to and detachable from the deck 2. This structural arrangement enables vessel operators D having various physical sizes to operate the hydrofoil craft 1, for example, by preparing a plurality of hydrofoils 3 that are mutually different in size and by replacing a hydrofoil 3 with another in accordance with the physical size of a vessel operator D. Additionally, it is possible to compactly store the hydrofoil craft 1 by detaching the hydrofoil 3 from the deck 2 and then disassembling the hydrofoil craft 1.

In the present preferred embodiment, the power generator 41 that generates electric power to operate the electric motor 35 of the thruster 6 is disposed in the central area 2C in the right-left direction of the deck 2. This structural arrangement makes it possible to dispose the power generator 41 adjacent or near the gravity center G (see FIG. 2) of the hydrofoil craft 1, and thus makes it possible to achieve an arrangement that enables the vessel operator D to receive a feeling of speed and enabling the vessel operator D to control the speed while improving the kinematic performance of the hydrofoil craft 1.

In the present preferred embodiment, the hydrofoil craft 1 additionally includes the float 4 disposed at the deck 2 and at the hydrofoil 3. According to this structural arrangement, the hydrofoil craft 1 floats at a standstill due to the float 4, thus enabling the vessel operator D to easily ride on or dismount from the hydrofoil craft 1 when it is at a standstill. This makes it possible to achieve an arrangement that enables the vessel operator D to receive a feeling of speed and that enables the vessel operator D to control the speed while enabling the vessel operator D to easily ride on or dismount from the craft.

Although preferred embodiments of the present invention have been described above, the present invention is not restricted to the contents of these preferred embodiments and various modifications are possible within the scope of the present invention.

In the above preferred embodiments, a difference between the thrust of the thruster 6L and the thrust of the thruster 6R is made by adjusting the pulling amount of the lever 43 of the left thrust operator 7L and the pulling amount of the lever 43 of the right thrust operator 7R, thus enabling the vessel operator to change the traveling direction of the hydrofoil craft 1 while turning the hydrofoil craft 1. In this case, the lever 43 of each of the left and right thrust operators 7L and 7R is an accelerator lever. Instead of this, the lever 43 of either the left thrust operator 7L or the right thrust operator 7R may be an accelerator lever that evenly changes both the thrust of the thruster 6L and the thrust of the thruster 6R. In that case, the vessel operator may turn the grip 42 of one of or the other one of the left and right thrust operators 7L and 7R so that a difference between the thrust of the thruster 6L and the thrust of the thruster 6R is produce in accordance with its turning angle. Additionally, the thrust operator 7 may include, for example, a single joy stick so that the traveling direction and/or the speed of the hydrofoil craft 1 is able to be changed by the vessel operator operating the joy stick with the left hand LH or the right hand RH. Additionally, the thrust operator 7 may be operated not with the left hand LH or the right hand RH but with the left leg LF or the right leg RF.

As long as the vessel operator D is able to operate the craft in a prone position, the arrangement of the portions of the hydrofoil craft 1 may be appropriately changed. For example, in the lower-limb placing portion 12, the left-leg placing portion 21 and the right-leg placing portion 22 may be arranged so as to extend rearwardly in parallel. Additionally, the lower-limb placing portion 12 may linearly extend rearwardly from the chest placing portion 11 without being divided into the left-leg placing portion 21 and the right-leg placing portion 22. If so, the deck 2 preferably has the shape of the letter Y in a plan view, and the vessel operator D operates the craft while placing the left and right legs, which are in a closed state, on the lower-limb placing portion 12.

In the upper-limb placing portion 13, the left-arm placing portion 29, and the right-arm placing portion 30 may be arranged so as to extend forwardly in parallel. Additionally, the upper-limb placing portion 13 may linearly extend forwardly from the chest placing portion 11 without being divided into the left-arm placing portion 29 and the right-arm placing portion 30. If so, the deck 2 preferably has a reverse-Y shape in a plan view, and the vessel operator D operates the craft while placing the left and right arms, which are in a closed state, on the upper-limb placing portion 13. Additionally, if the lower-limb placing portion 12 is not divided into the left-leg placing portion 21 and the right-leg placing portion 22, the deck 2 preferably has the shape of the letter I in a plan view, and the vessel operator D operates the craft in a state in which the left and right arms and the left and right legs are closed.

Instead of being attached to the deck 2 or to the front hydrofoil 31, the float 4 may be attached at another position (for example, the rear hydrofoil 32) of the hydrofoil craft 1.

Instead of being attached to the rear hydrofoil 32, the thruster 6 may be attached at another position (for example, the front hydrofoil 31 or the deck 2) of the hydrofoil craft 1. The thruster 6 may generate a thrust not by a jet propulsion machine but by the rotation of a propeller (not shown) disposed outside the housing 33 instead of the impeller 34. The thruster 6 may rotate the impeller 34 or the propeller by the driving force of an internal combustion engine instead of the electric motor 35.

The various features described above may be appropriately combined together.

Also, features of two or more of the various preferred embodiments described above may be combined.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A hydrofoil craft comprising:

a deck arranged to enable a vessel operator to ride on the deck in a prone position, the deck including a central portion on which a chest of the vessel operator is placed, a rear portion that is disposed at a more rearward position than the central portion and on which a lower limb of the vessel operator is placed, and a forward portion that is disposed at a more forward position than the central portion and on which an upper limb of the vessel operator is placed;

a hydrofoil disposed below the deck;

a thruster that generates a thrust; and a thrust operator that is operated by the vessel operator to adjust the thrust of the thruster; wherein the deck has a shape of a letter X or a letter Y in a plan view; the forward portion includes a left-forward portion on which a left arm of the vessel operator is placed and a right-forward portion that is disposed at a more rightward position than the left-forward portion and on which a right arm of the vessel operator is placed; and a distance between the left-forward portion and the right-forward portion becomes greater as the left-forward portion and the right-forward portion extend forward from the central portion.

2. The hydrofoil craft according to claim 1, wherein the central portion has a shape extending along at least a portion of the chest of the vessel operator, and the rear portion has a shape extending along at least a portion of the lower limb of the vessel operator.

3. The hydrofoil craft according to claim 2, wherein an upper surface of at least one of the central portion and the rear portion has a concave shape.

4. The hydrofoil craft according to claim 1, wherein the upper surface of the central portion tilts more downwardly as the central portion extends toward a rearward end of the upper surface.

5. The hydrofoil craft according to claim 1, wherein the forward portion has a shape extending along at least a portion of the upper limb of the vessel operator.

6. The hydrofoil craft according to claim 1, wherein the deck further includes:

an additional portion that is disposed at a more forward position than the central portion and on which a head of the vessel operator is placed; and an upper surface of the additional portion has a concave shape.

7. The hydrofoil craft according to claim 1, wherein the left-forward portion and the right-forward portion are arranged laterally symmetrically.

8. The hydrofoil craft according to claim 1, wherein the rear portion includes a left-rear portion on which a left leg of the vessel operator is placed and a right-rear portion that is disposed at a more rightward position than the left-rear portion and on which a right leg of the vessel operator is placed.

9. The hydrofoil craft according to claim 8, wherein a distance between the left-rear portion and the right-rear portion becomes greater as the left-rear portion and the right-rear portion extend rearward from the central portion.

10. The hydrofoil craft according to claim 9, wherein the left-rear portion and the right-rear portion are arranged laterally symmetrically.

11. The hydrofoil craft according to claim 1, wherein the thrust operator includes a left thrust operator disposed at the left-forward portion and a right thrust operator disposed at the right-forward portion.

12. The hydrofoil craft according to claim 11, wherein, in a vertical direction, the left thrust operator is disposed at a more downward position than a center of the left-forward portion, and the right thrust operator is disposed at a more downward position than a center of the right-forward portion.

13. The hydrofoil craft according to claim 11, wherein the left thrust operator and the right thrust operator are disposed laterally symmetrically.

14. The hydrofoil craft according to claim 11, wherein the thruster includes a left and right pair of thrusters; and a thrust of a first thruster of the left and right pair of thrusters is adjusted by an operation of the left thrust operator by the vessel operator, and a thrust of a second thruster of the left and right pair of thrusters is adjusted by an operation of the right thrust operator by the vessel operator.

15. The hydrofoil craft according to claim 1, wherein the hydrofoil includes a front hydrofoil that tilts more downwardly from an outer edge of the deck as the front hydrofoil extends toward a rearward end of the front hydrofoil.

16. The hydrofoil craft according to claim 15, wherein the front hydrofoil tilts more downwardly as the front hydrofoil extends toward the rearward end of the front hydrofoil from the forward portion.

17. The hydrofoil craft according to claim 16, wherein the left-forward portion and the right-forward portion tilt more downwardly as the left-forward portion and the right-forward portion extend forward from the central portion; and the front hydrofoil connects a left lower edge of the left-forward portion and a right lower edge of the right-forward portion together.

18. The hydrofoil craft according to claim 17, wherein the front hydrofoil includes a left portion that first extends rightward and downward from the left lower edge of the left-forward portion and then extends rightward and upward, and a right portion that first extends leftward and downward from the right lower edge of the right-forward portion and then extends leftward and upward.

19. The hydrofoil craft according to claim 15, further comprising a reinforcing portion that extends downward from the deck and is connected to the front hydrofoil.

20. The hydrofoil craft according to claim 15, wherein the hydrofoil includes a rear hydrofoil disposed at a more rearward position than the front hydrofoil.

21. The hydrofoil craft according to claim 20, wherein the thruster is disposed at the hydrofoil.

22. The hydrofoil craft according to claim 21, wherein the thruster is attached to the rear hydrofoil.

23. The hydrofoil craft according to claim 1, wherein the hydrofoil is attachable to and detachable from the deck.

24. The hydrofoil craft according to claim 1, wherein the thruster includes an electric motor; and the hydrofoil craft further comprises a power generator that is disposed at the deck and generates electric power to operate the electric motor.

25. The hydrofoil craft according to claim 24, wherein the power generator is disposed in a central area in a right-left direction of the deck.

26. The hydrofoil craft according to claim 1, further comprising a float provided in at least one of the deck and the hydrofoil.

* * * * *